US010433579B2

(12) United States Patent
Mola

(10) Patent No.: US 10,433,579 B2
(45) Date of Patent: Oct. 8, 2019

(54) FLEECE FOR SMOKELESS TOBACCO

(71) Applicant: British American Tobacco (Investments) Limited, London (GB)

(72) Inventor: Michele Mola, London (GB)

(73) Assignee: British American Tobacco (Investments) Limited, London (GB)

( * ) Notice: Subject to any disclaimer, the term of this patent is extended or adjusted under 35 U.S.C. 154(b) by 982 days.

(21) Appl. No.: 13/863,056

(22) Filed: Apr. 15, 2013

(65) Prior Publication Data

US 2013/0276805 A1 Oct. 24, 2013

(30) Foreign Application Priority Data

Apr. 20, 2012 (GB) ..... 1206966.2

(51) Int. Cl.
*A24F 23/02* (2006.01)

(52) U.S. Cl.
CPC ..... *A24F 23/02* (2013.01); *Y10T 428/23986* (2015.04)

(58) Field of Classification Search
None
See application file for complete search history.

(56) References Cited

U.S. PATENT DOCUMENTS

| | | | | |
|---|---|---|---|---|
| 5,167,244 | A | 12/1992 | Kjerstad | |
| 2003/0213108 | A1 | 11/2003 | Strandqvist | |
| 2007/0207239 | A1* | 9/2007 | Neidle | A23G 3/48 426/77 |
| 2008/0202536 | A1 | 8/2008 | Torrence | |
| 2009/0022917 | A1 | 1/2009 | Gedevanishvili et al. | |
| 2012/0073588 | A1 | 3/2012 | Kawata et al. | |

FOREIGN PATENT DOCUMENTS

| | | | | |
|---|---|---|---|---|
| DE | 102004030393 | | 1/2006 | |
| EP | 0245575 | A1 * | 11/1987 | A47J 31/08 |
| JP | 03240665 | A * | 10/1991 | |
| WO | WO 2008114133 | A1 * | 9/2008 | B29C 65/08 |
| WO | 2010052100 | | 5/2010 | |

OTHER PUBLICATIONS

"Thread." Merriam-Webster.com. Accessed Nov. 13, 2017. https://www.merriam-webster.com/dictionary/thread.*
European Search Report dated Sep. 16, 2013, for European Patent Application No. 13162315.9.

* cited by examiner

*Primary Examiner* — Michael J Felton
(74) *Attorney, Agent, or Firm* — McKee, Voorhees & Sease, PLC

(57) ABSTRACT

A fleece for a smokeless tobacco pouch is disclosed. The fleece comprises a material and at least one thread attached to said material.

11 Claims, 4 Drawing Sheets

THREAD

- A plurality of threads
  - Plurality of threads attached to the material by stitching
  - Paths formed by each of the plurality of stitched threads parallel or not parallel
- Thread attached to a portion of the fleece remote from a first seal
- Thread attached to at least one of the second and the third seal

FIG. 6

FLEECE FOR SMOKELESS TOBACCO

TECHNICAL FIELD

The present disclosure relates to a fleece that is used to form individual pouches of smokeless tobacco such as snus. The disclosure also relates to a pouch for smokeless tobacco formed from a fleece, and to a method of manufacture.

PRIORITY CLAIM

This application claims priority under 35 USC § 119 to United Kingdom Patent Application GB 1206966.2 filed Apr. 20, 2012, entitled "Fleece for Smokeless Tobacco." The entire contents of the aforementioned application are expressly incorporated by reference herein.

BACKGROUND

Snus is a type of smokeless tobacco product that may be separated into individual portions and contained within permeable pouches that may be placed in a user's mouth.

SUMMARY

The present disclosure describes various embodiments of a fleece and a snus product formed from such fleece.

According to the present disclosure, a fleece for a smokeless tobacco pouch comprises a material and at least one thread attached to said material.

In one embodiment, the at least one thread is incorporated into said material.

In some embodiments, the at least one thread is adhered to a surface of said material.

The at least one thread may be treated with a flavorant prior to being attached to said material.

The at least one thread may be coated with a coating material that delays the release of the flavorant.

In one embodiment, the at least one thread is of a contrasting color or different opacity to the material of the fleece.

The at least one thread may have a diameter between 0.5 to 5 mm.

In an alternative embodiment, the at least one thread comprises a plurality of threads attached to the material.

The plurality of threads may be of contrasting colors or different opacity.

According to another embodiment, there is provided a smokeless tobacco pouch formed from the fleece as described above.

In one embodiment, the pouch comprises two longitudinal edges sealed together with a first seal, and two opposite ends sealed together with second and third seals, respectively.

The thread may be attached to a portion of the fleece remote from said first seal.

The thread may form the first seal on the pouch by stitching together said longitudinal edges.

In one embodiment, the thread is attached to the second and/or the third seal.

The pouch may comprise a smokeless tobacco product.

According to yet another embodiment, there is provided a method of manufacturing a fleece for a smokeless tobacco pouch, comprising forming a material configured to form a body of a pouch and attaching a thread to said material.

In one embodiment, attaching a thread comprises stitching it into the material. In an alternative embodiment, the method comprises stitching the thread so that it forms a predetermined pattern.

According to a further embodiment, there is provided a method of manufacturing a fleece for a smokeless tobacco pouch by hydroentanglement, the method including introducing a thread during hydroentanglement.

BRIEF DESCRIPTION OF THE DRAWINGS

Embodiments of the present invention(s) will now be described, by way of non-limiting example only, with reference to the accompanying drawings, in which:

FIG. 6 is a diagram showing characterisitics of a thread according to some embodiments.

DETAILED DESCRIPTION

Figure 1:
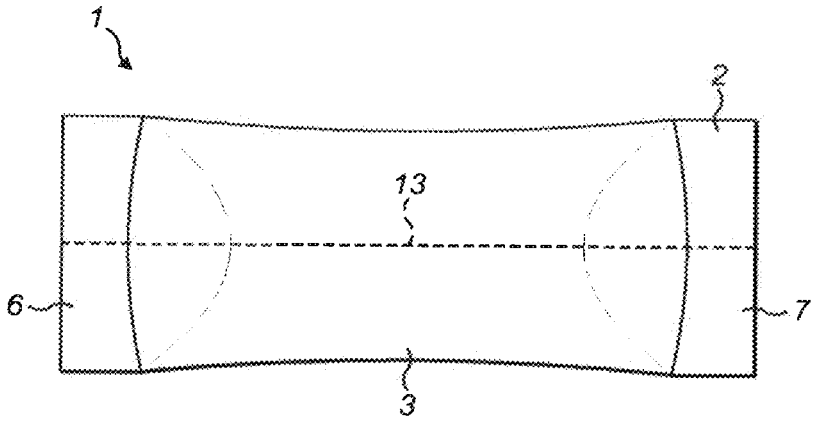
FIG. 1 shows a planar top view of a snus pouch according to one embodiment.
Figure 2:
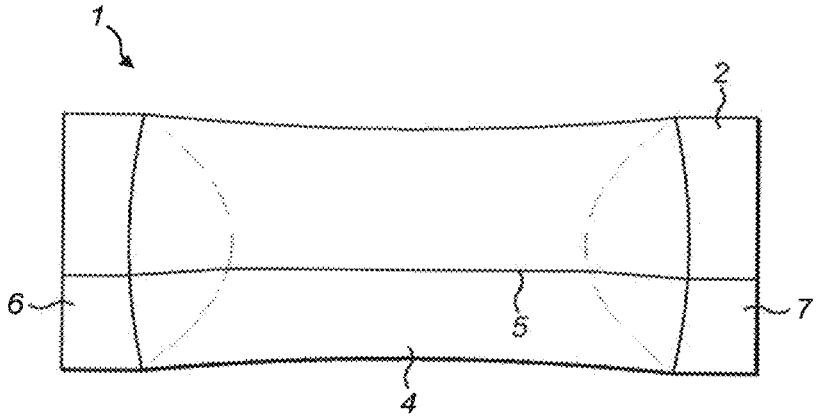
FIG. 2 shows a planar rear view of the embodiment shown in FIG. 1.

Referring now to the drawings, a snus pouch 1 has a body made of a sheet of material 2, as shown in FIGS. 1 and 2. The sheet of material 2 may be formed of a permeable material including, but not limited to, non-woven cellulose fibres, that may be held together with a binder and/or as a result of mechanical operations during manufacturing.

The snus pouch 1 comprises a front face 3 and an opposing rear face 4. The rear face 4 is formed with a first seal 5 which seals together two longitudinal edges of the fleece, as explained in more detail below. Second seal 6 and third seal 7 seal opposite ends of the pouch. Said seals 6 and 7 may, in some embodiments, be perpendicular to or otherwise nonparallel to seal 5.

A thread 13 is incorporated into and/or onto the front face 3 of the snus pouch such that it extends along a longitudinal axis of the front face 3 between the second and third seals 6, 7. Said thread may be positioned along the center of front face 3 or, in some embodiments, may deviate from the center.

In one embodiment, the thread 13 is incorporated into the fleece prior to forming individual pouches. The thread 13 may be incorporated into the fleece by stitching it in a continuous line along the length of the material 2 so that when the snus pouch is formed, the thread 13 is located along a central longitudinal axis of the front face 3 of the snus pouch 1.

Figure 3:
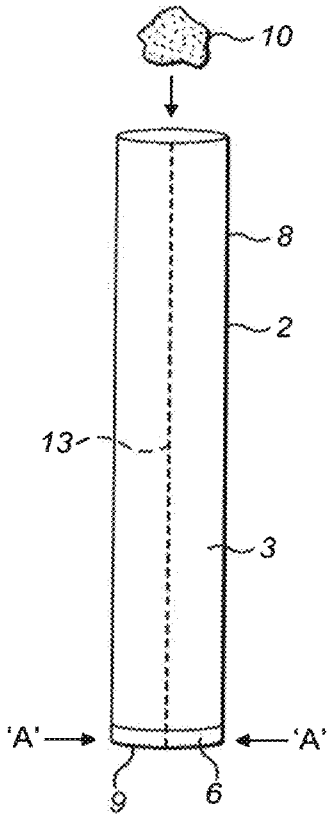
FIG. 3 illustrates a production view of a snus pouch according to some embodiments.
Figure 4:
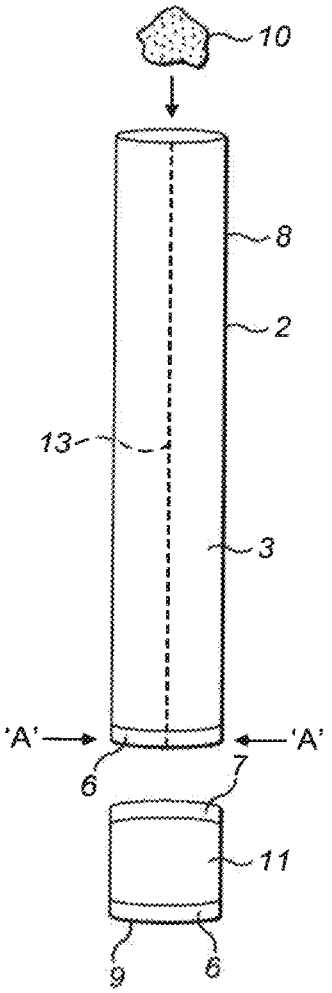
FIG. 4 illustrates another production view of a snus pouch according to some 10 embodiments.

The snus pouch 1 may be formed from the fleece using a snus manufacturing machine, in which a continuous reel of fleece material is processed on a continuous basis and which fills, seals and cuts the fleece into individual snus portions. For embodiments wherein the thread is incorporated into the fleece prior to mounting a reel on the snus manufacturing machine, the sheet of material 2 incorporated with a thread may be folded such that two longitudinal edges of the sheet of material 2 meet and are aligned with one another. The two longitudinal edges may thereafter be sealed to each other so as to form the first seal 5. In some embodiments, the first seal 5 is a heat seal formed by applying heat to at least a portion of the two longitudinal edges, causing a binder to melt. The heat, in such embodiments, is then removed and as the binder cools the two longitudinal edges may be sealed to one another such that the sheet of material 2 forms a tube 8 as seen in FIGS. 3 and 4. The first seal 5 may then be folded so that it lies parallel with the rear face 4 as can be appreciated in FIG. 2. It is further contemplated that in some embodiments the two longitudinal edges, prior to sealing, may be brought together such that they overlap, forming a tube having a cross-sectional shape corresponding to any one of a teardrop, circle, cardioid, etc., with the subsequent seal being formed along the region of overlap. While the manufacturing process described above discusses the continuous processing of snus pouches, it should be understood that batch, customized, or other non-continuous manufacturing schedules may be employed in combination with, or as an alternative to, continuous processing.

Thereafter, the tube 8 of material is sealed at end 9, forming a second seal 6 as indicated by the region between arrows 'A' in FIGS. 3 and 4. An injection or directed burst of portioned snus product 10 may be placed within tube 8 toward the closed end of the tube, and a seal (e.g., a heat seal) is made in the fleece above the top of the snus portion forming the third seal 7. A rutting means is then employed to cut along the third seat so that a discrete snus pouch 11 is formed as illustrated in FIG. 4.

The third seal 7 may be cut, such that a portion of the third seal 7 remains along the edge of the tube 8. This portion of seal 7 may then form at least part of the second seal 6 of a subsequent snus pouch that is to be formed.

An additional portioned snus product 10 is then placed toward the second seal 6 within the tube 8 of fleece and a seal (e.g., a heat seal) is made in the fleece above the top of the snus portion so as to form a third seal 7 of the subsequent snus pouch. Any of the aforementioned seals may, in some embodiments, be formed using a non-toxic adhesive and/or other room temperature joining means.

The above procedure may, in some embodiments, be repeated on a continuous basis. In the embodiments shown in FIGS. 1 to 4, the thread 13 is incorporated into the sheet of material 2 before the snus pouch is formed. The thread 13 may be treated with a flavorant prior to being stitched into the sheet of material 2. The thread 13 can be treated with a flavorant by soaking or spraying the thread with said flavorant. The concept of a thread treated with a flavorant may be understood to include a thread that is either fully or partly impregnated with a flavorant or a thread wherein the flavorant is adsorbed to the surface of said thread. The flavorant may, in some embodiments, add a taste and/or an aroma to the snus pouch 1 which may be released when a user places the snus product in their mouth.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the thread 13 treated with a flavorant may also be coated with a coating material prior to being incorporated into the fleece so as to delay the release of the flavorant. The coating material may comprise vegetable fat, paraffin, wax or a gum, for example, xanthan gum. The coating may be configured to disintegrate or melt when it reaches a pre-determined temperature. By way of example, a coating material may be used which has a melting point around 37° C. such that the flavorant provided on or in the thread is not released until a user places the snus pouch in their mouth and the heat of the body melts the coating material away from the thread.

Alternatively, the thread may be encapsulated or coated in a blend comprising both the coating material and a flavorant. Such an embodiment may also provide for the release of flavorant to be delayed. In embodiments wherein the flavorant is blended throughout the coating material, a gradual release of the flavorant may be achieved.

It shall also be appreciated that a plurality of threads (for example, two or three threads) may be incorporated into the fleece. The threads may be treated with the same or different flavorants. Some of the threads may be coated with a coating material so that release of the flavorants occurs gradually throughout consumption of the snus by a user, for example to prolong the release of flavorant or to provide a user with a variety of flavors as they consume the snus. For example, a snus pouch fleece may have three threads treated with the same flavorants incorporated into them. Two of the threads may be coated with a coating material, wherein one of the coatings is thicker than the other. In such an embodiment, during use, the release of the flavorant of the uncoated thread may occur as soon as the user places the snus pouch in their mouth and it comes into contact with saliva. The release of the flavorant of the thread having a thinner coating may be delayed until the flavorant of the thread without a coating has faded or nearly faded, and the flavorant of the thread having a thicker coating may be delayed until the flavorants of the other two threads have almost been completely released.

In a further embodiment, the three threads may be each treated with different flavorants, for example so that different flavors may be experienced in a sequence.

In addition to, or instead of being flavored, the thread may also have a particular or distinctive color or opacity so as to provide a visual differentiation from threads of other snus pouches. The thread 13 may also be incorporated into any part of the fleece and may follow any path through it.

If a plurality of threads is employed, they may be of the same or different colors or they may differ in opacity. In some embodiments, the colors of the thread(s) may evolve during consumption of the final snus product, losing, gaining or changing color, for example as a colored flavorant or a colorant is depleted. The threads may further differ in the presence and/or type of flavourant applied, or none of the threads may contain flavorant. The threads may follow paths parallel to one another, or the threads may form a wavy, sawtooth or random pattern, or any other desired arrangement.

It is also envisaged that in any of the above described embodiments, the thread(s) may be incorporated into the material by using any type of stitches. By way of example, back stitch, cross stitch or running stitch may be used.

Figure 5:
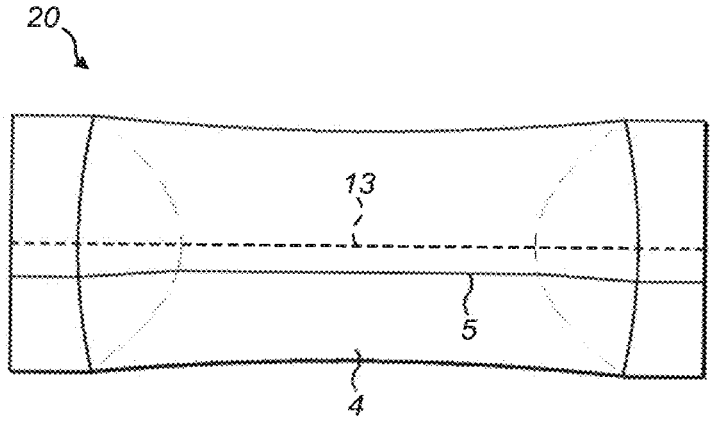
FIG. 5 shows a planar rear view of another embodiment.

Another embodiment will now be described with reference to FIG. 5. The snus pouch is similarly configured to the embodiment described with reference to FIGS. 1 to 4, however the thread is stitched into the first seal 5, as opposed to being stitched into the front face 3. In this embodiment, the first seal 5 may be formed using heat as described above with reference to FIGS. 3 and 4 such that the sheet of material 2 forms a tube 8. Thereafter, the thread 13 may be incorporated into the first seal 5. This configuration may, for example, give the impression that the thread 13 alone is sealing the snus pouch 20.

Although seals 5, 6, and 7 are referred to as 'first,' 'second,' and 'third' seals, respectively, these labels and/or reference numbers, as well as others throughout this disclosure, are employed for the purpose of illustrating some of the disclosed embodiments, and are not to imply any required order or exclusivity of other arrangements for all embodiments.

The snus pouch 20 may comprise, individually or in combination, any of the optional features discussed above in relation to the embodiments of FIGS. 1 to 4.

Seal 5 of the pouch is not necessarily formed by applying heat as previously described. Instead, the thread may be incorporated or stitched into the two longitudinal edges of the sheet of material so as to seal the two long edges together and form a tube out the sheet of material. In other embodiments, the seal may also be formed by both heat sealing and stitching the thread.

It is also envisaged that a thread treated with flavorant may be incorporated along second and/or third seals of a snus pouch. The thread may, for example, be stitched into the second and/or third seal such that the thread appears to seal the respective edges of the pouch. The thread may, in other embodiments, be the only means used for sealing one or both of the two short edges of said pouch.

The thread (flavored or otherwise) may in some embodiments be stitched or otherwise incorporated into the front face of the snus pouch in a pattern, for example forming a word or a logo. The patterned stitching may be incorporated instead of, or in addition to, the implementations described elsewhere in the present disclosure.

Although the above embodiments have been described as having a thread incorporated into a fleece comprising non-woven fibres, it should be understood that the fleece may instead or in combination comprise fibres woven together.

In the above embodiments, the thread is described as being incorporated into the fleece after manufacture but prior to formation of the snus pouches. In a non-illustrated embodiment, however, the thread may instead be incorporated into the fleece during its manufacture.

A non-woven fleece for a snus pouch may in some embodiments be formed by a technique referred to as hydroentanglement. Hydroentanglement may involve carding a network of fibres and placing the network of fibres between two plates. One of the plates may comprise a pattern of holes and be referred to as an embossing plate. High pressure water may be directed through the holes of the embossing plate so as to form areas having a lower density than the surrounding areas. Thereafter, a binder may be added to the network of fibres which sets so as to form a non-woven fleece. The mechanical operation of the hydroentanglement technique and the binder may, together or individually, cause the fibres to be held together.

In embodiments involving hydroentanglement, a thread, which may be pre-treated with flavorant, may be added to the network of fibres before or after high pressured water is applied. Therefore, in such embodiments, when the binder has been added and set, the thread is incorporated into the sheet of material.

The thread may be of any color or opacity and treated with any flavorant as described with reference to FIGS. 1 to 4. It should be appreciated that a plurality of threads having the same or different flavorants can be incorporated into the sheet of material using hydroentanglement. The thread or some of the threads may be coated with a coating material as described with reference to FIGS. 1 to 4.

It is envisaged that a thread may be positioned during the hydroentanglement procedure such that it follows a pattern, for example forming a word or logo.

Although the above embodiments describe a fleece for snus, it should be understood that the fleece described herein could also be used for any other form of smokeless tobacco product. Additionally, the sheet of material is not limited to cellulose, and can instead or in combination be formed of any other material suitable for forming a pouch that is to be filled with non-smokeable tobacco (for example cotton, cellulose acetate or polylactic acid).

In yet another un-illustrated embodiment, the thread may be incorporated into the fleece after the pouch has been formed. The thread may be incorporated using any of the methods discussed above in connection with the other embodiments. Although the thread has been described as being incorporated by stitching or through hydroentanglement, the thread can also be adhered to the surface of the sheet of material prior to or after forming a snus pouch. The thread can be adhered for example using an adhesive.

In any of the embodiments mentioned above, the thread is preferably 0.5 to 5 mm in diameter, however the thread is not limited to this range. The thread can be made of a variety of materials, for example, cellulose, cotton, cellulose acetate or polylactic acid.

Although embodiments of the invention have been shown and described, it will be appreciated by those persons skilled in the art that the foregoing description should be regarded as a description of exemplary embodiments only and that other embodiments that fall within the scope of the appended claims are considered to form part of this disclosure.

In order to address various issues and advance the art, the entirety of this disclosure shows by way of illustration various embodiments in which the claimed invention(s) may be practiced and provide for superior pouches for smokeless articles. The advantages and features of the disclosure are of a representative sample of embodiments only, and are not exhaustive and/or exclusive. They are presented only to assist in understanding and teach the claimed principles. It should be understood that they are not representative of all claimed embodiments. As such, certain aspects of the disclosure have not been discussed herein. That certain embodiments may not have been presented, or that further undescribed embodiments may be available, is not to be considered a disclaimer of those embodiments. It will be appreciated that many of those undescribed embodiments incorporate the same principles of the present disclosure, and that others are equivalent. Thus, it is to be understood that other embodiments may be utilized and modifications may be made without departing from the scope and/or spirit of the disclosure. As such, all examples, implementations, and/or embodiments are deemed to be non-limiting throughout this disclosure. Also, no inference should be drawn regarding those embodiments discussed herein relative to those not discussed herein other than that it is as such for purposes of reducing space and repetition. Various embodiments may suitably comprise, consist of, or consist essentially of, various combinations of the disclosed elements, components, features, parts, steps, means, etc. Some of the disclosed features, elements, implementation, etc., may be mutually contradictory, in that they cannot be simultaneously present in a single embodiment. Similarly, some features are applicable to one aspect of the disclosure, and inapplicable to others. In addition, the disclosure includes other embodiments not presently claimed. Applicant reserves all rights in those presently unclaimed embodiments including the right to claim such embodiments, file additional applications, continuations, continuations in part, divisionals, and/or the like thereof. As such, it should be understood that advantages, embodiments, examples, function, features, structural characteristics, and/or other aspects of the disclosure are not to be considered limitations on the disclosure as defined by the claims or limitations on equivalents to the claims.

The invention claimed is:

1. A fleece for a smokeless tobacco pouch comprising a material and at least one thread incorporated into said material, wherein said at least one thread not used to close a seal of the fleece used for the smokeless tobacco pouch, wherein the at least one thread is stitched into said material.

2. The fleece according to claim 1, wherein the at least one thread is treated with at least one flavorant prior to being incorporated into said material.

3. The fleece according to claim 2, wherein the at least one thread is coated with at least one coating material that delays the release of the at least one flavorant.

4. The fleece according to claim 1, wherein the at least one thread is at least one of a different color and different opacity with respect to the material of the fleece.

5. The fleece according to claim 1, wherein the at least one thread has a diameter between 0.5 and 5 mm.

6. The fleece according to claim 1, wherein the at least one thread comprises a plurality of threads, and wherein the plurality of threads color includes threads which differ in at least one of color and opacity.

7. The fleece according to claim 3, wherein the at least one thread comprises a plurality of threads, and wherein the thickness of the coating material varies among said threads.

8. A smokeless tobacco pouch formed from a fleece comprising a material and at least one thread incorporated into said material, where said at least one thread not used to close a seal of the fleece used for the smokeless tobacco pouch, wherein the at least one thread is stitched into said material.

9. The pouch according to claim 8, wherein said material comprises two longitudinal edges sealed together with a first seal, and two opposite ends sealed together with second and third seals, respectively.

10. The pouch according to claim 8, comprising a smokeless tobacco product.

11. A fleece for a smokeless tobacco pouch comprising a material and at least one thread incorporated into said material, wherein said at least one thread not used to close a seal of the fleece used for the smokeless tobacco pouch, wherein the at least one thread is treated with at least one flavorant prior to being incorporated into said material, and wherein the at least one thread is stitched into said material.

* * * * *